US008216994B2

(12) United States Patent
Hodge et al.

(10) Patent No.: US 8,216,994 B2
(45) Date of Patent: Jul. 10, 2012

(54) PHOSPHATE FUNCTIONALIZED ALKYL POLYGLUCOSIDES USED FOR ENHANCED FOOD SOIL REMOVAL

(75) Inventors: Charles A. Hodge, Cottage Grove, MN (US); Amanda R. Blattner, Prior Lake, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/614,818

(22) Filed: Nov. 9, 2009

(65) Prior Publication Data

US 2011/0112009 A1 May 12, 2011

(51) Int. Cl.
*C11D 3/37* (2006.01)
*C11D 17/00* (2006.01)

(52) U.S. Cl. ..... 510/514; 510/436

(58) Field of Classification Search ..... 510/514, 510/436

See application file for complete search history.

(56) References Cited

U.S. PATENT DOCUMENTS

| | | | | |
|---|---|---|---|---|
| 5,001,114 | A * | 3/1991 | McDaniel, Jr. | 514/25 |
| 5,118,440 | A | 6/1992 | Cutler et al. | |
| 5,254,290 | A | 10/1993 | Blandiaux et al. | |
| 5,691,289 | A | 11/1997 | Purcell et al. | |
| 5,780,417 | A | 7/1998 | Gorlin | |
| 5,807,816 | A | 9/1998 | Cottrell et al. | |
| 5,948,742 | A | 9/1999 | Chang et al. | |
| 6,060,441 | A | 5/2000 | Hessel et al. | |
| 6,369,021 | B1 | 4/2002 | Man et al. | |
| 6,627,612 | B1 | 9/2003 | O'Lenick, Jr. et al. | |
| 6,881,710 | B1 | 4/2005 | O'Lenick, Jr. et al. | |
| 6,958,315 | B1 | 10/2005 | Anderson et al. | |
| 6,964,942 | B2 | 11/2005 | Murch et al. | |
| 7,087,571 | B1 | 8/2006 | O'Lenick, Jr. et al. | |
| 7,335,627 | B1 | 2/2008 | O'Lenick et al. | |
| 7,341,983 | B2 | 3/2008 | Pedersen et al. | |
| 7,507,399 | B1 | 3/2009 | O'Lenick, Jr. et al. | |
| 2002/0035051 | A1 | 3/2002 | Alam et al. | |
| 2002/0055448 | A1 | 5/2002 | Ruggiero et al. | |
| 2002/0151448 | A1 | 10/2002 | Mitra et al. | |
| 2002/0183222 | A1 | 12/2002 | Foley et al. | |
| 2002/0189028 | A9 * | 12/2002 | Mettrie et al. | 8/405 |
| 2003/0064910 | A1 | 4/2003 | Fong et al. | |
| 2003/0073600 | A1 | 4/2003 | Avery et al. | |
| 2003/0119689 | A1 | 6/2003 | Hutton et al. | |
| 2003/0134765 | A1 | 7/2003 | Kapur et al. | |
| 2004/0029752 | A1 | 2/2004 | Sava et al. | |
| 2004/0182425 | A1 | 9/2004 | Kravitz et al. | |
| 2005/0101508 | A1 | 5/2005 | Winter et al. | |
| 2005/0239674 | A1 | 10/2005 | Dreja et al. | |
| 2006/0135397 | A1 * | 6/2006 | Bissey-Beugras et al. | 510/475 |
| 2006/0222614 | A1 | 10/2006 | Buck | |
| 2006/0281653 | A1 | 12/2006 | Hutton et al. | |
| 2008/0139443 | A1 | 6/2008 | Buzinski et al. | |
| 2008/0255014 | A1 | 10/2008 | Luu et al. | |
| 2009/0007936 | A1 | 1/2009 | Uhl et al. | |

FOREIGN PATENT DOCUMENTS

| | | |
|---|---|---|
| EP | 0140452 | 12/1989 |
| EP | 0086614 | 11/1997 |
| EP | 0623670 | 7/2001 |
| EP | 0659874 | 10/2002 |
| EP | 0805200 | 7/2003 |
| EP | 0691397 | 10/2004 |
| EP | 1290122 | 5/2007 |
| GB | 2194955 | 3/1988 |
| GB | 2272450 | 5/1994 |
| GB | 2290798 | 1/1996 |
| GB | 2336373 | 10/1999 |
| GB | 2370042 | 6/2002 |
| KR | 10-2003-0083158 | 10/2003 |
| WO | WO9316162 | 8/1993 |
| WO | WO9319149 | 9/1993 |
| WO | WO9403572 | 2/1994 |
| WO | WO9412609 | 6/1994 |
| WO | WO9502390 | 1/1995 |
| WO | WO9618711 | 6/1996 |
| WO | WO9711146 | 3/1997 |
| WO | WO9811185 | 3/1998 |
| WO | WO9812294 | 3/1998 |
| WO | WO9855569 | 12/1998 |
| WO | WO0100779 | 1/2001 |
| WO | WO03080780 | 10/2003 |
| WO | WO2006124484 | 11/2006 |
| WO | WO2008088647 | 7/2008 |
| WO | WO2008/094718 | 8/2008 |
| WO | WO2008094718 | 8/2008 |

OTHER PUBLICATIONS

GLUCOPON® 625 UP, www.cognis.com, Aug. 18, 2008, 2 pages.
Glucopon® Surfcants, All You Need for Environmentally Friendly & Safe Cleansing Applications, Cognis Corporation, Jun. 2006, 1 page.
The Original APG®, Cognis Corporation, Apr. 2006, 1 page.
Plurafac® SL-42 Linear Alcohol Alkoxylate, BASF, © 2002, 2 pages.
Plurafac® SL-42 Linear Alcohol Alkoxylate, Technical Bulletin, BASF, © 2007, 2 pages.
Suga®Nate, Colonial Chemical, Inc., © Copyright 2007, 4 pages.
Suga®Phos, Colonial Chemical, Inc., last modified Jul. 18, 2006, 6 pages.

* cited by examiner

*Primary Examiner* — Ling Choi
*Assistant Examiner* — Thuy-Ai Nguyen
(74) *Attorney, Agent, or Firm* — Andrew D. Sorensen; Shaoni L. Mitchell

(57) ABSTRACT

A cleaning composition including a $C_{12}$ phosphate functionalized alkyl polyglucoside, a water conditioning agent and water. In one embodiment, the cleaning composition is substantially free of alkyl phenol ethoxylates. The cleaning composition is capable of removing soils including up to 20% proteins.

8 Claims, No Drawings

PHOSPHATE FUNCTIONALIZED ALKYL POLYGLUCOSIDES USED FOR ENHANCED FOOD SOIL REMOVAL

TECHNICAL FIELD

The present invention relates to the field of hardsurface cleaning compositions. In particular, the invention relates to a hardsurface cleaning composition including a phosphate functionalized alkyl polyglucoside.

BACKGROUND

Conventional detergents used in the warewashing and laundering industries, particularly those intended for institutional use, generally contain alkyl phenol ethoxylates (APEs). APEs are used in detergents as a cleanser and a degreaser for their effectiveness at removing soils containing grease from a variety of surfaces. Commonly used APEs include nonyl phenol ethoxylates (NPE) surfactants.

However, while effective, APEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods. There is therefore a need in the art for an environmentally friendly and biodegradable alternative that can replace APEs in hardsurface cleaners.

SUMMARY

In one embodiment, the present invention is a hardsurface cleaner including between about 22.5% and about 60% by weight $C_{12}$ phosphate functionalized alkyl polyglucoside, between about 4% and about 8% by weight water conditioning agent and between about 26.45% and about 73.25% by weight water. The hardsurface cleaner is substantially free of alkyl phenol ethoxylates.

In another embodiment, the present invention is a method of removing soils from a surface. The method includes diluting a cleaner with water of dilution to form a use solution and contacting the surface with the use solution. The cleaner includes a $C_{12}$ phosphate functionalized alkyl polyglucoside, a water conditioning agent and water. The use solution is capable of removing soils including up to 20% proteins.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Phosphate Functionalized Alkyl Polyglucoside Containing Compositions and Methods Employing Them The present invention relates to hardsurface cleaning compositions and methods of using the cleaning compositions for cleaning and removing organic soils from a surface. In particular, the cleaning composition is effective at removing soils including proteins, lard and oils from various surfaces. For example, the cleaning composition is effective at removing soils containing up to about 20% protein. The cleaning compositions include a phosphate functionalized alkyl polyglucoside component having a carbon chain of about $C_{12}$. The phosphate functionalized alkyl polyglucoside component is also a bio-based surfactant, manufactured using renewable carbon and is thus an alternative to synthetic oil based surfactants. In one embodiment, the cleaning compositions are substantially free of alkyl phenol ethoxylates (APEs) such as nonyl phenol ethoxylates (NPEs). Thus, the cleaning compositions provide a green, readily biodegradeable replacement for conventional detergent surfactants. The cleaning compositions can be used in various industries, including, but not limited to: manual and automatic warewashing, food and beverage, vehicle care, quick service restaurants and textile care. In particular, the cleaning compositions can be used in hard-surface cleaning applications, including, for example: bathroom surfaces, dishwashing equipment, food and beverage equipment, vehicles and tabletops. The cleaning compositions can also be used in laundering applications.

In one embodiment, the cleaning composition includes a phosphate functionalized alkyl polyglucoside, a water conditioning agent, an acid source and water. In one embodiment, the cleaning composition may also include a co-surfactant.

The phosphate functionalized alkyl polyglucoside is an anionic surfactant naturally derived from alkyl polyglucosides and has a sugar backbone. Without being bound by theory, it is believed that the sugar backbone of the phosphate functionalized alkyl polyglucoside facilitates the breakdown of proteins, making them easier to remove. Phosphate functionalized alkyl polyglucosides have the following formula:

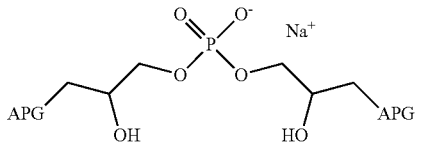

Examples of suitable phosphate functionalized alkyl polyglucosides which can be used in the cleaning compositions according to the present invention include those in which the alkyl moiety contains about 12 carbon atoms. An example of a suitable phosphate functionalized alkyl polyglucoside includes, but is not limited to, sodium dilaurylglucoside hydroxypropyl phosphate. An example of a commercially suitable phosphate functionalized alkyl polyglucoside useful in cleaning compositions of the present invention includes, but is not limited to: SUGA®PHOS 1200 (a $C_{12}$ phosphate functionalized alkyl polyglucoside) available from Colonial Chemical, Inc., located in South Pittsburg, Tenn.

The water conditioning agent aids in removing metal compounds and in reducing harmful effects of hardness components in service water. Exemplary water conditioning agents include chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces and can reduce or eliminate the inappropriate interaction with active ingredients including the nonionic surfactants and anionic surfactants of the invention. Both organic and inorganic water conditioning agents are common and can be used. Inorganic water conditioning agents include such compounds as sodium tripolyphosphate and other higher linear and cyclic polyphosphates species. Organic water conditioning agents include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

The acid source functions to neutralize the water conditioning agent. An example of a suitable acid source includes, but is not limited to, phosphoric acid. The acid source controls the pH of the resulting solution when water is added to the cleaning composition to form a use solution. The pH of the use solution must be maintained in the neutral to slightly alkaline range in order to provide sufficient detergency properties. This is possible because the soil removal properties of the cleaning composition are primarily due to the phosphate functionalized alkyl polyglucoside and co-surfactant combination, rather than the alkalinity of the cleaning composition. In one embodiment, the pH of the use solution is between approximately 6.5 and approximately 10. In particular, the pH of the use solution is between approximately 8 and approximately 9. If the pH of the use solution is too low, for example, below approximately 6, the use solution may not provide adequate detergency properties. If the pH of the use solution is too high, for example, above approximately 11, the use solution may be too alkaline and attack or damage the surface to be cleaned.

A feature of the cleaning composition of the invention is that it has an enhanced degreasing ability while remaining substantially free of a solvent. A solvent is often times useful in degreaser compositions to enhance soil removal properties. Surprisingly, cleaning compositions of the present invention do not require a non-aqueous or aqueous solvent in order to perform well as degreasers. However, the cleaning compositions may include a solvent to adjust the viscosity of the final composition. The intended final use of the composition may determine whether or not a solvent is included in the cleaning composition. If a solvent is included in the cleaning composition, it is usually a low cost solvent such as isopropyl alcohol. It should be noted that a solvent is not necessary to boost the effectiveness of compositions of the present invention. Rather, a solvent may or may not be included to improve handleability or ease of use of the compositions of the invention. Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

The cleaning composition also includes water. It should be appreciated that the water may be provided as deionized water or as softened water. The water provided as part of the concentrate can be relatively free of hardness. It is expected that the water can be deionized to remove a portion of the dissolved solids. That is, the concentrate can be formulated with water that includes dissolved solids, and can be formulated with water that can be characterized as hard water.

In concentrate form, the cleaning compositions include between about 22.5 wt % and about 60 wt % phosphate functionalized alkyl polyglucoside, between about 4 wt % and about 8 wt % water conditioning agent, between about 0.1 wt % and about 0.55 wt % acid source and between about 26.45 wt % and about 73.25 wt % water. Particularly, the cleaning compositions include between about 30 wt % and about 55 wt % phosphate functionalized alkyl polyglucoside, between about 5 wt % and about 7 wt % water conditioning agent, between about 0.2 wt % and about 0.5 wt % acid source and between about 30 wt % and about 60 wt % water. More particularly, the cleaning compositions include between about 35 wt % and about 50 wt % phosphate functionalized alkyl polyglucoside, between about 5 wt % and about 6.5 wt % water conditioning agent, between about 0.25 wt % and about 0.5 wt % acid source and between about 40 wt % and about 50 wt % water. In other embodiments, similar concentrations may also be present in the cleaning compositions of the invention.

In one embodiment, the cleaning compositions of the present invention are substantially free of APEs, making the detergent composition more environmentally acceptable. APE-free refers to a composition, mixture, or ingredients to which APEs are not added. Should APEs be present through contamination of an APE-free composition, mixture, or ingredient, the level of APEs in the resulting composition is less than approximately 0.5 wt %, less than approximately 0.1 wt %, and often less than approximately 0.01 wt %.

Additional Functional Materials

The cleaning compositions can include additional components or agents, such as additional functional materials. As such, in some embodiments, the cleaning composition including the phosphate functionalized alkyl polyglucoside may provide a large amount, or even all of the total weight of the cleaning composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use. The cleaning preparations containing the phosphate functionalized alkyl polyglucoside an may optionally contain other soil-digesting components, surfactants, disinfectants, sanitizers, acidulants, complexing agents, corrosion inhibitors, foam inhibitors, dyes, thickening or gelling agents, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Surfactants

The cleaning composition can contain an anionic surfactant component that includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. An suitable alkyl aryl sulfonate includes linear alkyl benzene sulfonate. An suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. An suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An suitable alkoxy group is ethoxy. An suitable alkyl ether sulfate is sodium lauric ether ethoxylate sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium laurel sulfate and sodium laurel/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, when provided as a concentrate, can include the anionic surfactant component in an amount sufficient to provide a use composition having desired wetting and detersive properties after dilution with water. The concentrate can contain about 0.1 wt % to about 0.5 wt %, about 0.1 wt % to about 1.0 wt %, about 1.0 wt % to about 5 wt %, about 5 wt % to about 10 wt %, about 10 wt % to about 20 wt %, 30 wt %, about 0.5 wt % to about 25 wt %, and about 1 wt % to about 15 wt %, and similar intermediate concentrations of the anionic surfactant.

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition.

Nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Additional nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauramide diethanolamide, cocoamide diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the detergent composition concentrate, they can be included in an amount of at least about 0.1 wt % and can be included in an amount of up to about 15 wt %. The concentrate can include about 0.1 to 1.0 wt %, about 0.5 wt % to about 12 wt % or about 2 wt % to about 10 wt % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphrodipropionates, aminopropionates, aminodipropionates, amphoacetates, amphodiacetates, and amphohydroxypropylsulfonates.

When the detergent composition includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The cleaning composition can contain a cationic surfactant component that includes a detersive amount of cationic surfactant or a mixture of cationic surfactants. The cationic surfactant can be used to provide sanitizing properties.

Cationic surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Thickening Agents

The viscosity of the cleaning composition increases with the amount of thickening agent, and viscous compositions are useful for uses where the cleaning composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.1 wt % to about 3 wt %, from about 0.1 wt % to about 2 wt %, or about 0.1 wt % to about 0.5 wt %.

Bleaching Agents

The cleaning composition may also include bleaching agents for lightening or whitening a substrate. Examples of suitable bleaching agents include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, and chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

Detergent Fillers

The cleaning composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included in an amount of between about 1 wt % and about 20 wt % and between about 3 wt % and about 15 wt %.

Defoaming Agents

The cleaning composition can include a defoaming agent to reduce the stability of foam and reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Antiredeposition Agents

The cleaning composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt % and about 10 wt % and between about 1 wt % and about 5 wt %.

Stabilizing Agents

Stabilizing agents that can be used in the cleaning composition include, but are not limited to: primary aliphatic amines, betaines, borate, calcium ions, sodium citrate, citric acid, sodium formate, glycerine, maleonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to about 20 wt %, between about 0.5 wt % to about 15 wt % and between about 2 wt % to about 10 wt %.

Dispersants

Dispersants that can be used in the cleaning composition include maleic acid/olefin copolymers, polyacrylic acid, and its copolymers, and mixtures thereof. The concentrate need not include a dispersant, but when a dispersant is included it can be included in an amount that provides the desired dispersant properties. Exemplary ranges of the dispersant in the concentrate can be up to about 20 wt. %, between about 0.5 wt. % and about 15 wt %, and between about 2 wt % and about 9 wt %.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Adjuvants

The present composition can also include any number of adjuvants. Specifically, the cleaning composition can include stabilizing agents, wetting agents, thickeners, foaming agents, corrosion inhibitors, biocides, hydrogen peroxide, pigments or dyes among any number of other constituents which can be added to the composition. Such adjuvants can be pre-formulated with the present composition or added to the system simultaneously, or even after, the addition of the present composition. The cleaning composition can also contain any number of other constituents as necessitated by the application, which are known and which can facilitate the activity of the present compositions.

Embodiments of the Present Compositions

The cleaning composition of the present invention is effective at removing soils containing proteins, lard and oils. In one embodiment, the cleaning composition is effective at removing soils containing up to about 20% protein. Several suitable exemplary liquid concentrate compositions are provided in the following tables.

TABLE 1

| Exemplary Composition | | | |
|---|---|---|---|
| Component | First Range (Wt %) | Second Range (Wt %) | Third Range (Wt %) |
| Water | 26.45-73.25 | 30-60 | 40-50 |
| Phosphoric Acid (75%) | 0.25-0.55 | 0.1-0.5 | 0.25-0.5 |
| Isopropanol (99%) | 0-5 | 1-4 | 2-4 |
| SUGA ® PHOS 1200 (40%) | 22.5-60 | 30-55 | 35-50 |
| EDTA (40%) | 4-8 | 5-7 | 5-6.5 |

The concentrate composition of the present invention can be provided as a solid, liquid, or gel, or a combination thereof. In one embodiment, the cleaning compositions may be provided as a concentrate such that the cleaning composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

When provided as a liquid concentrate composition, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning When the cleaning composition is provided as a solid, the compositions provided above in Tables 1-4 may be altered in a manner to solidify the cleaning composition by any means known in the art. For example, the amount of water may be reduced or additional ingredients may be added to the cleaning composition, such as a solidification agent.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

The water used to dilute the concentrate (water of dilution) can be available at the locale or site of dilution. The water of dilution may contain varying levels of hardness depending upon the locale. Service water available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:8. If a light duty cleaning use solution is desired, it is expected that the concentrate can be diluted at a weight ratio of concentrate to water of dilution of up to about 1:256.

In an alternate embodiment, the cleaning compositions may be provided as a ready-to-use (RTU) composition. If the cleaning composition is provided as a RTU composition, a more significant amount of water is added to the cleaning composition as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little as possible in order to reduce transportation costs, it is also desirable to provide a concentrate that can be dispensed accurately. In the case of a liquid concentrate, it is expected that water will be present in an amount of up to about 90 wt %, particularly between about 20 wt % and about 85 wt %, more particularly between about 30 wt % and about 80 wt. % and most particularly between about 50 wt % and about 80 wt %.

In the case of a RTU composition, it should be noted that the above-disclosed cleaning composition may, if desired, be further diluted with up to about 96 wt % water, based on the weight of the cleaning composition.

Compositions of the invention may be useful to clean a variety of surfaces. Invention compositions may be used to clean soils on hard surfaces including but not limited to ceramics, ceramic tile, grout, granite, concrete, mirrors, enameled surfaces, metals including aluminum, brass, stainless steel and the like. Compositions of the invention may also be used to clean soiled linens such as towels, sheets, and nonwoven webs. As such, compositions of the invention are useful to formulate hard surface cleaners, laundry detergents, oven cleaners, hand soaps, automotive detergents, and warewashing detergents whether automatic or manual.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

SUGA®PHOS 1000: a $C_{10}$ phosphate functionalized alkyl polyglucoside available from Colonial Chemical, Inc., located in South Pittsburg, Tenn.

SUGA®PHOS 1200: a $C_{12}$ phosphate functionalized alkyl polyglucoside available from Colonial Chemical, Inc., located in South Pittsburg, Tenn.

Trycol ST 8049: a $C_8$ alcohol ethoxylate with 5 moles EO having a cloud point of about 79° C., available from Cognis, headquartered in Monheim, Germany.

Basophor HE 50: a $C_6$ alcohol ethoxylate with 5 moles EO having a cloud point of about 93° C., available from BASF Corporation, located in Ludwigshafen, Germany Tomadol 91-6: a $C_9$-$C_{11}$ alcohol ethoxylate with 6 moles EO having a cloud point of between about 47 and about 58° C., available from Air Products, located in Allentown, Pa.

Tomadol 25-7: a $C_{12}$-$C_{15}$ alcohol ethoxylate with 7 moles EO having a cloud point of between about 46 and about 54° C., available from Air Products, located in Allentown, Pa.

Plurafac SL 42: an ethoxylated, propoxylated $C_{10}$ extended chain surfactant with 6 moles EO and 3 moles PO having a cloud point of about 42° C. available from BASF Corporation, located in Ludwigshafen, Germany.

Super Excellent: a cleaner available from Ecolab Inc., Saint Paul, Minn.

Red Soil Removal Test

A red soil consisting of lard, oil, protein, and iron (III) oxide (for color) was prepared. About 30 grams of lard was combined with about 30 grams of corn oil, about 15 grams of whole powdered egg, and about 1.5 grams of $Fe_2O_3$.

The back, grooved sides of a plurality of 3"×3" white vinyl tiles were soiled with approximately 0.75 grams of the red soil using a 3" foam brush. The tiles were allowed to dry at room temperature overnight. It is believed that this incubation period allowed the bonds holding the triglycerides and proteins together in the soil to begin to crystallize and interlink. The next day, the tiles were placed into a soaking tray containing about 200 grams of a test composition for about 1 minute.

The soil removal test was conducted using a Precision Force Applicator (PFA), available from Precision Analytical Instruments, Inc., using a synthetic sponge. The PFA is similar to the Gardner Straightline Apparatus except that it is interfaced with a computer to control various parameters, such as, for example speed, number of repetitions time between cycles, etc. The synthetic sponge was pre-dampened with water with the excess water squeezed out and then saturated with about 50 grams of the test compositions. The tiles were then placed into the PFA with the grain of the tiles parallel to the direction of sponge travel. The tiles were scrubbed with about 2 pounds of pressure with the moistened synthetic sponge for 16 cycles, rotating the tiles 90 degrees every 4 cycles for a complete 360 degree rotation of the tiles. The tiles were then rinsed with city water and dried overnight at room temperature. Hunter Lab L* reflectance of the soiled tiles and washed tiles were measured. The soiled tiles L* reflectance value is represented by the following equation:

$$\text{soiled } L'^* = \frac{1}{3.38 \ln\left(\frac{92.1 - 24.74}{\text{soiled } L^* - 24.74}\right)}$$

where 3.38, 92.1, and 24.74 are constants. The washed tiles L* reflectance value is represented by the following equation:

$$\text{washed } L'^* = \frac{1}{3.38 \ln\left(\frac{92.1 - 24.74}{\text{washed } L^* - 24.74}\right)}$$

The percent soil removal was then calculated as:

$$\text{percent soil removal} = \left(\frac{\text{soiled } L'^* - \text{washed } L'^*}{\text{soiled } L'^*}\right) * 100$$

The compositions were evaluated based on two standards. First, the compositions were evaluated to determine whether an acceptable amount of red soil was removed at low concentrations (i.e., 4 oz/gallon), intermediate concentrations (i.e., 8 oz/gallon) and high concentrations (i.e., 16 oz/gallon). At 18% actives, a composition was considered to perform at an acceptable level if it removed at least about 72% red soil at low concentrations, at least about 79% red soil at intermediate concentrations and at least about 86% red soil at high concentrations.

If the composition removed an acceptable amount of red soil at all concentrations, the compositions were then evaluated to determine whether they performed substantially similarly to, and could act as a suitable replacement for, a commercially known cleaner. Two compositions were considered to behave substantially similarly if the amount of red soil removed was within about 10% at low and high concentrations and within about 15% at intermediate concentrations.

Example 1 and Comparative Examples A and B

To test the ability of compositions of the present invention and comparative compositions to remove red soil from a surface according to the method described above, various compositions were formulated at 4, 8 and 16 ounce per gallon concentrations and about 18% activity.

Example 1 is a composition of the present invention and included a $C_{12}$ phosphate functionalized alkyl polyglucoside. In particular, the composition of Example 1 included SUGA®PHOS 1200.

The composition of Comparative Example A was a comparative example and included a $C_{10}$ phosphate functionalized alkyl polyglucoside. In particular, the composition of Comparative Example A included SUGA®PHOS 1000. The composition of Comparative Example B included the composition of a commercially known hard surface cleaner, Super Excellent. Water was used as a control.

Table 2 provides the concentration and percent of red soil removal for each of the compositions of Example 1, the compositions of Comparative Examples A and B and water.

TABLE 2

| | Concentration (oz/gal) | Red Soil Removal (%) |
|---|---|---|
| Example 1 | 4 | 78.52 |
| | 8 | 87.33 |
| | 16 | 91.03 |
| Comparative Example A | 4 | 73.83 |
| | 8 | 74.48 |
| | 16 | 78.72 |
| Comparative Example B | 4 | 79.06 |
| | 8 | 87.75 |
| | 16 | 91.46 |
| Water | — | 72.80 |

Table 2 illustrates that a composition including a $C_{12}$ phosphate functionalized alkyl polyglucoside (Example 1) had greater red soil removing capabilities than a composition including a $C_{10}$ phosphate functionalized alkyl polyglucoside (Comparative Example A) and had substantially similar red soil removing capabilities as a commercially known product (Comparative Example B).

As the concentration increased from 4 oz/gal to 16 oz/gal, the composition of Example 1 exhibited increased red soil removing properties compared to the composition of Comparative Example A. In particular, at 4 oz/gal, the composition of Example 1 removed about 5% more red soil than the composition of Comparative Example A and at 16 oz/gal, the composition of Example 1 removed about 12% more red soil than the composition of Comparative Example A.

The amount of red soil removed by compositions of Example 1 and Comparative Example B were substantially similar at all concentrations. At most, there was about a 1% difference in the amount of red soil removed.

As expected, all of the compositions of Example 1 and Comparative Examples A and B removed more red soil than water.

Comparative Examples C, D, E, F, G and H

Once it was determined that a $C_{12}$ phosphate functionalized alkyl polyglucoside outperformed a $C_{10}$ phosphate functionalized alkyl polyglucoside, the $C_{12}$ phosphate functionalized alkyl polyglucoside was combined with various co-surfactants at 1:1 actives ratios to test their ability to remove red soil. The compositions were formulated at 4, 8 and 16 ounce per gallon concentrations and about 18% activity.

The composition of Comparative Example C included SUGA®PHOS 1200 and Trycol ST 8049. The composition of Comparative Example D included SUGA®PHOS 1200 and Basophor HE 50. The composition of Comparative Example E included SUGA®PHOS 1200 and Plurafac SL-42. The composition of Comparative Example F included SUGA®PHOS 1200 and Tomadol 25.7 and the composition of Comparative Example G included SUGA®PHOS 1200 and Tomadol 91.6.

The composition of Comparative Example H included the composition of a commercially known hard surface cleaner, Super Excellent. Water was also used as a control.

Table 3 provides the concentration and percent of red soil removed for each of the compositions of Comparative Examples C, D, E, F, G and H and water.

TABLE 3

| | Concentration (oz/gal) | Red Soil Removal (%) |
|---|---|---|
| Comparative Example C | 4 | 68.38 |
| | 8 | 76.84 |
| | 16 | 90.69 |
| Comparative Example D | 4 | 65.46 |
| | 8 | 69.73 |
| | 16 | 75.45 |
| Comparative Example E | 4 | 71.76 |
| | 8 | 76.79 |
| | 16 | 85.01 |
| Comparative Example F | 4 | 69.55 |
| | 8 | 72.92 |
| | 16 | 80.40 |
| Comparative Example G | 4 | 70.90 |
| | 8 | 74.27 |
| | 16 | 84.11 |
| Comparative Example H | 4 | 79.06 |
| | 8 | 87.75 |
| | 16 | 91.46 |
| Water | — | 72.80 |

As illustrated in Table 3, when the $C_{12}$ phosphate functionalized alkyl polyglucoside was combined with the other co-surfactants (Comparative Examples C, D, E, F and G), the compositions did not remove an acceptable amount of red soil at all dilution levels or perform substantially similarly to the composition of Comparative Example H at all dilution levels.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A cleaning composition comprising:

(a) a $C_{12}$ hydroxypropyl phosphate functionalized alkyl polyglucoside with a formula consisting of

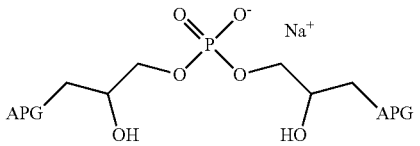

(b) a water conditioning agent; and (c) water;

(d) wherein the cleaning composition comprises less than about 0.5% by weight alkyl phenol ethoxylates.

2. The cleaning composition of claim 1, wherein the cleaning composition comprises less than about 0.1% by weight alkyl phenol ethoxylates.

3. The cleaning composition of claim 1, wherein the $C_{12}$ hydroxypropyl phosphate functionalized alkyl polyglucoside constitutes between about 22.5% and about 60% by weight of the cleaning composition.

4. The cleaning composition of claim 1, wherein the water conditioning agent constitutes between about 4% and about 8% by weight of the cleaning composition.

5. The cleaning composition of claim 1, wherein the water constitutes between about 26.45% and about 73.25% by weight of the cleaning composition.

6. The cleaning composition of claim 1, further comprising an acid source constituting between about 0.25% and about 0.55% by weight of the cleaning composition.

7. The cleaning composition of claim 1, wherein the water conditioning agent comprises ethylenediaminetetraacetic acid tetrasodium salt.

8. The cleaning composition of claim 1, wherein the cleaning composition has a pH of between about 6.5 and about 10.

* * * * *